US007735333B2

(12) United States Patent
Tso

(10) Patent No.: US 7,735,333 B2
(45) Date of Patent: Jun. 15, 2010

(54) THERMAL COMPENSATION SYSTEM AND DEVICE THERE OF IN HEAT PUMP AND REFRIGERATION SYSTEM

(76) Inventor: Ming-Li Tso, No. 69-3, Jing-Mei Street, Taipei (TW)

( * ) Notice: Subject to any disclaimer, the term of this patent is extended or adjusted under 35 U.S.C. 154(b) by 0 days.

(21) Appl. No.: 11/171,335

(22) Filed: Jul. 1, 2005

(65) Prior Publication Data

US 2007/0000276 A1 Jan. 4, 2007

(51) Int. Cl.
*F25B 13/00* (2006.01)

(52) U.S. Cl. ..... 62/324.1; 62/238.1

(58) Field of Classification Search ..... 62/324.1, 62/160, 324.2, 238.1, 278; 165/65
See application file for complete search history.

(56) References Cited

U.S. PATENT DOCUMENTS 5,427,175 A * 6/1995 Nagasawa ..... 165/209
5,592,826 A * 1/1997 Sagar et al. ..... 62/195

* cited by examiner

*Primary Examiner*—Melvin Jones
(74) *Attorney, Agent, or Firm*—Guice Patents PLLC

(57) ABSTRACT

An air conditioning and refrigeration system includes a compressor, a four-way valve, two delivering guide pipes joined to two lateral sides of the four-way valve, two thermal compensation devices and two heat exchangers. Even if the air conditioner is a window type in association with a rotary compressor, the purpose of slow running with fast temperature reduction can be reached by means of doubling refrigerant filling and flow process regulation. Meanwhile, hi/lo pressure ratio 4:1 (cool room) or 8:1 even higher (warm room) is the most novel design of the air conditioner and it is capable of secure the indoor comfort. Besides, in case of the present invention being applied to the refrigeration system, the four-way valve inverse direction of the refrigerant being changed to enhance the efficiency thereof without using tungsten filament for defrosting.

13 Claims, 2 Drawing Sheets

THERMAL COMPENSATION SYSTEM AND DEVICE THERE OF IN HEAT PUMP AND REFRIGERATION SYSTEM

FIELD OF THE INVENTION

The present invention relates to an air conditioning and refrigeration system and particularly to a system in which high temperature gaseous refrigerant and lubricant sent out by a compressor selectively pass through a thermal compensation device by means of a four-way valve switching and move toward an outdoor heat exchanger or an indoor heat exchanger for heat release condenser or heat absorption-evaporator and the recovery low pressure gaseous refrigerant and lubricant are arranged to pass through a thermal compensation device such that cold oil in suction line rises temperature thereof in addition to the high pressure liquid refrigerant in discharge line lowering temperature thereof to enhance better effect of a running compressor.

BACKGROUND OF THE INVENTION

According to difference of living environments, an air conditioning system usually is installed in a house for promoting living quality and comfort. For instance, the cool air conditioner is frequently used in the area of temperate zone and tropics and the warm air conditioner is frequently used in the area of cold zone. Nevertheless, sometimes, it is hot during summer in the areas of temperate zone and the cold zone too and people often can't stand cold wave in the area of temperate zone during winter. Hence, it is essential that an air conditioning system with cool air and warm air supply in our daily lives.

The warm air supply of the current used air conditioning system basically has a heat source such as vapor coming from a boiler heating up the water to the boiling state and the vapor is delivered to rooms via pipeline. However, it is not suitable for residents without central air conditioning system. For ordinary family houses, the air conditioner mostly has provided filament heat device for air blown out being warm. However, due to indoor rooms being different from each other, it frequently results in the warm air being insufficient warm enough. Besides, the conventional electric heater provides insufficient warm air supply and occurs a phenomenon of oxygen consuming. Moreover, when the refrigerant circulates in the air conditioning and refrigeration system, the lubricant in the refrigerant becomes sticky in a cold state while the refrigerant passes through the evaporator and decreases temperature thereof abruptly. As a result, it is unfavorable for lubrication of the compressor and poor lubrication often greatly increases ampere amount of current such that load increases during running and it is dangerous to the user.

In order to improve the conventional air conditioning system, the present inventor has endeavored in design and development of air conditioning system for many years and is granted many patents in Taiwan and United States. For instance, U.S. Pat. No. 6,092,377 entitled "Air cooled two stage condenser for air conditioning and refrigeration system" (corresponding to Taiwanese Patent Official Gazette No. 428077, U.S. Pat. No. 6,370,901 entitled "Compound evaporation system and device thereof" (corresponding to Taiwanese Patent Official Gazette No. 457359 and Taiwanese Patent Official Gazette No. 494222 entitled "Method for reinforcing condensation and a device thereof (corresponding to U.S. patent application Ser. No. 09/878,415).

SUMMARY OF THE INVENTION

An object of the present invention is to provide an air conditioning and refrigeration system, which includes a compressor, connecting a four-way valve with a pipeline, the four-way valve being controlled to selectively direct high temperature gaseous refrigerant with oil moving along a delivering pipe toward an outdoor or an indoor heat exchanger; and two thermal compensation devices, being connected to both ends of the delivering pipe respectively and further connected to the outdoor heat exchanger and the indoor heat exchanger respectively, the two heat exchangers being connected to each other with another pipeline; wherein, each of the thermal compensation devices has a branch pipe with a plurality of distributing capillary tubes at the terminate end thereof being attached to a coil pipe of the heat exchangers respectively for liquid refrigerant with oil being parallel injected into or guided out the heat exchangers and passing through a plurality of thermal compensation capillary tubes so as to occur thermal complement with another liquid or gaseous refrigerant with oil guided or discharged by a manifold next to the heat exchangers before entering related circulating path; whereby, cold oil from a evaporator absorbs heat of coming liquid by means of the coming liquid passing through the thermal compensation capillary tubes in the thermal compensation devices such that the oil increases temperature and is softened and the liquid refrigerant with oil lowers to the least temperature.

Another object of the present invention is to provide a thermal compensation device for an air conditioning and refrigeration system, which is disposed at a front part of a vaporization state heat exchanger and includes a branch pipe, providing a plurality of dividing flow capillary tubes at the terminated end thereof being joined to a coil pipe of the heat exchanger respectively; a plurality of thermal compensation tubes, being disposed therein for being passed through with liquid refrigerant with oil while the liquid refrigerant with oil is parallel injected into the device; and a manifold, surrounding the thermal compensation tubes, being passed through with low pressure gaseous refrigerant with oil such that the liquid refrigerant with oil occurs thermal complement action with the gaseous refrigerant with oil before the liquid refrigerant with oil returning to a compressor along a guide pipe; hence, cold oil with heat absence from a evaporator absorbs heat of coming liquid passing through the thermal compensation capillary tubes in the thermal compensation devices to increase oil temperature and soften the oil and the high pressure liquid refrigerant with oil is capable of lowering temperature thereof to the least temperature in ballance.

BRIEF DESCRIPTION OF THE DRAWINGS

The present invention can be more fully understood by reference to the following description and accompanying drawings, in which.

DETAILED DESCRIPTION OF THE INVENTION

Figure 1:
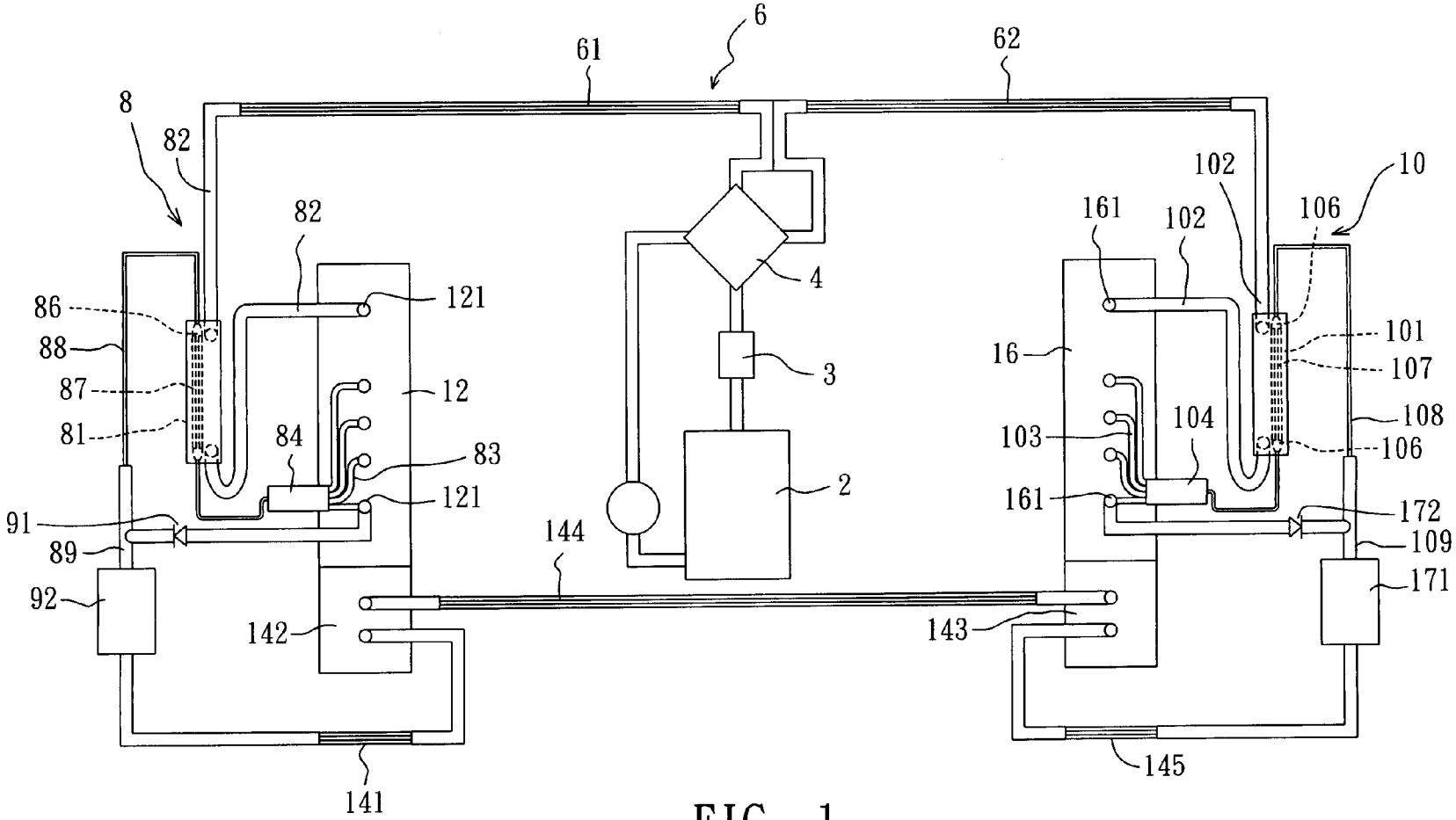
FIG. 1 is a plan view of an air conditioning and refrigeration system according to the present invention.

Referring to FIG. 1, basically, an air conditioning and refrigeration system with thermal compensation device according to the present invention includes a compressor 2, a four-way valve 4, a delivering pipe 6, two thermal compensation devices 8, 10, an outdoor heat exchanger 12, a condensing device 14 and an indoor heat exchanger 16.

Referring to FIG. 1 again, while the cold room operation is performed, the compressor 2 discharge high temperature and high pressured gaseous refrigerant with lubricant (or refrigeration oil) to pass through a filter 3 toward a four-way valve 4. The filtering screen 3 in the filter 3 removes foreign substance in the oil to avoid blocking the tube line such as capillary tube and cuts oily bubbles to release the gaseous refrigerant therein.

The four-way valve 4 is used for changing direction of the high temperature and high pressure gaseous refrigerant with oil such that the high temperature and high pressured gaseous refrigerant with oil moves along the delivering pipe 6 selectively based on the cool air or warm air being chosen so as to be diverted by the thermal compensation device 8 or 10 before processing toward the outdoor heat exchanger 12 and the indoor heat exchanger 16.

The delivering pipe 6 provides two guide pipe sections 61 and 62 to connect two openings of the four-way valve 4 respectively such that once the guide pipe section 61 is acted as the initial end of refrigerant (discharge end), the other guide pipe section 62 is acted as the return end thereof (suction end) and vice versa. The difference of the present application from the conventional air conditioning and refrigeration system in that each of the guide pipe sections 61, 62 is composed of a plurality of fine tubes for the refrigerant separating from the oil during flowing along the fine tubes so as to avoid the phenomenon of stagnation resulting from a single tube and influence subsequent condensation (cooling function). Besides, the guide pipe sections 61, 62 have a part approaching the four-way valve 4 adhesively contacting with each other for occurring thermal complement, i.e., the heat out end adheres the cold back end to allow temperature of the gaseous refrigerant with oil rising before returning the compressor 4 so as to soften the oil, which is helpful for more smooth running revolution of the compressor 4. Due to output gas velocity being increased, heat from coils of the compressor 4 is capable of discharging to attain temperature rise and decrease amperage of current. Because this action is not based on principle of pure heat exchange, the inventor calls it "second stage thermal compensation".

Figure 2:
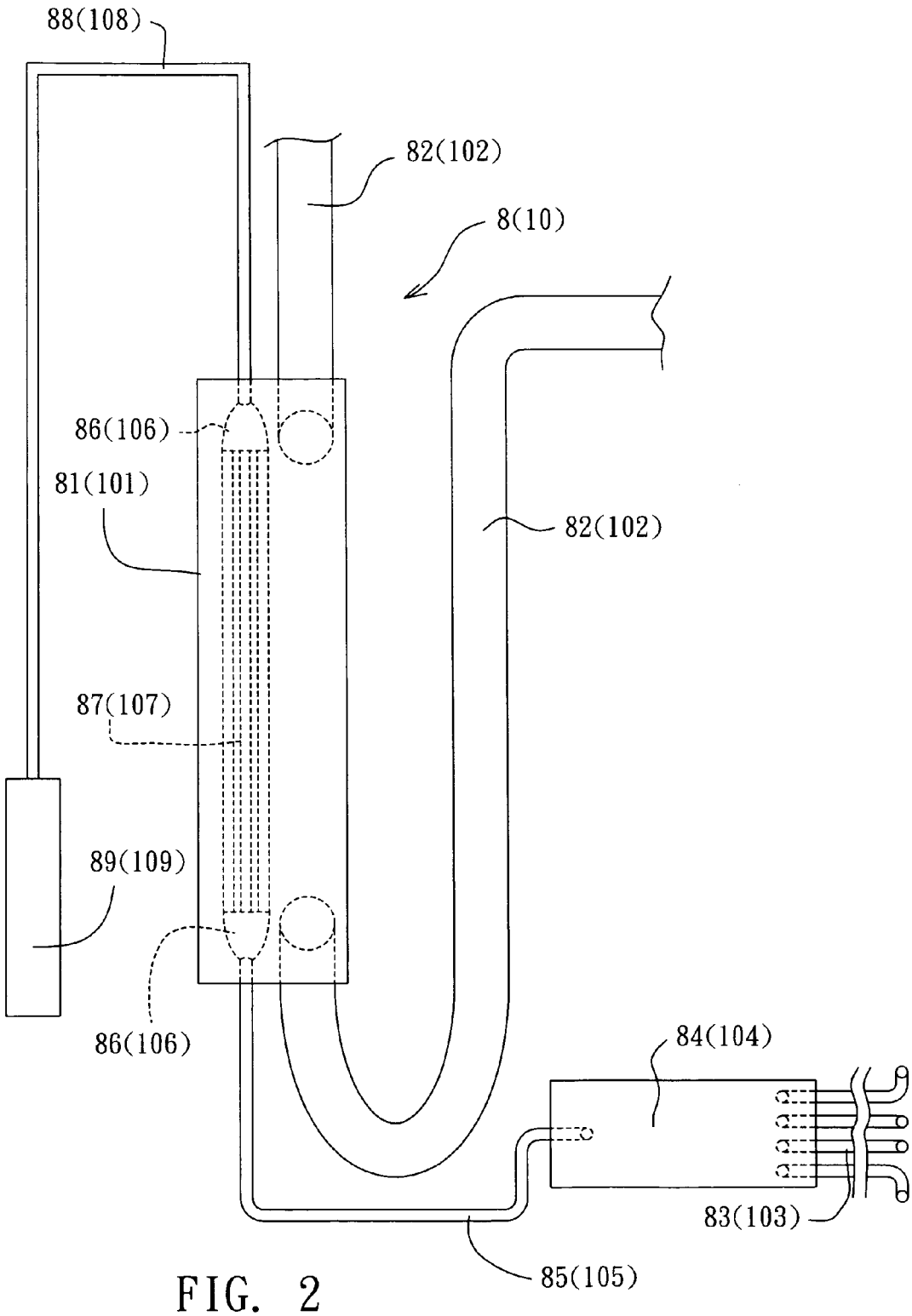
FIG. 2 is a plan view of a thermal compensation device in the air conditioning and refrigeration system of the present invention.

The thermal compensation device 8 is a divided manifold such as a four-way valve such that the high temperature gaseous refrigerant with oil can be injected into coil pipes 121, 121 of the heat exchangers 12, 16 with dividing flow respectively. At least a manifold 82 conduct to the main pipe 81 of the thermal compensation device 8 as shown in FIG. 2 connects with the guide pipe section 61 for the high temperature gaseous refrigerant with oil passes through the main pipe 81 and move downward to the entrance of the coil pipe 121 at the outdoor heat exchanger 12 via at least a manifold 82 below the main pipe 81 such that condensation (cooling) can be proceeded to let most refrigerant liquefied and entering a distributor filter 92 with oil via the outlet of the coil pipe 121 and a check valve 91. In order to achieve an expected effect of moving slowly and lowering temperature rapidly, the U shaped pipe at each bend of the coil pipe 121 is selectively connected to at least a divided capillary tube 83 for part of the liquid refrigerant with oil staying at a liquid receiver 84 temporarily. A leading pipe 85 at the bottom end of the liquid receiver 84 guides the liquid refrigerant with oil to a branch pipe 86 at the lower end of the main pipe 81 and the liquid refrigerant with oil passes through a plurality of thermal compensation capillary tubes 87 to heat exchange with the high temperature gaseous refrigerant with oil moving in the main pipe 81. Temperature of the liquid refrigerant with oil rises and is guided to another branch pipe 86 at top of the main pipe 81 so as to flow into the distributor filter 92 via a measuring capillary tube 88 and a guide pipe 89 such that bubbles in the high temperature liquid refrigerant with oil are broken by the screen in the distributor filter 92 and the foreign substances therein can be filtrate. While the gaseous refrigerant is changed to liquid refrigerant through the heat exchanger 12, pressure of the liquid refrigerant increases associated with slowing down amount of the liquid refrigerant.

The outdoor heat exchanger 12 and the indoor heat exchanger 16 are oppositely disposed to perform condensation (heat release) or evaporation (heatabsorption) selectively according to high temperature gaseous refrigerant or low temperature atomized refrigerant coming in accompanying with conventional fins and fans (not shown). The outdoor heat exchanger 12 or indoor heat exchanger 16 sends the coming refrigerant to the outdoor coil pipe 121 or the indoor coil pipe 161. These are prior art and no detail will be described further.

The condensation device 14 guides the liquid refrigerant, oil and bubbles from the distributor filter 92 into the first condensation intensified device 141, which is disclosed in Taiwanese Patent Official Gazette No. 494222 and granted to the present inventor, to treat the liquid, gas and oil with primary flow self-regulation such that while the liquid enters the device 141 and fills with those capillary tubes, the bubbles are kept outside due to the tiny diameter of the capillary pipe so as to enhance condensation effect. Then, the liquid, gas and oil congregate to flow into two liquid distributors 142, 143 in a compound evaporation system, which is disclosed in Taiwanese Patent Official Gazette No. 457359 and granted to the present inventor, to dissipate heat. The liquid distributors 142, 143 are respectively disposed below the outdoor and indoor heat exchangers 12, 16 and a second condensation reinforcing device 144, which is composed of a plurality of capillary tubes, is located between the liquid distributors 142, 143 to guide the coming liquid into the liquid distributor 143, which is disposed below the indoor heat exchanger 16. Thus, the liquid is flushed with the condensed water, which is obtained from being evaporated with indoor heat exchanger 16, such that the liquid is lowered temperature thereof and passes through a third condensation reinforcing device 145. During passing through the third condensation reinforcing device 145, the liquid provides a neutral property, i.e., no phenomenon of heat absorption or heat release occurs and the third condensation reinforcing device 145 regulates content of the cleared liquid refrigerant and the oil only (without bubbles).

The cleared liquid refrigerant and the oil further pass through a liquid filter 171 after moving out from the condensation device 14 and are stopped by a check valve 172. Under this circumstance, the cleared liquid refrigerant and the oil are directed to another thermal compensation device 10, which is identical with the thermal compensation device 8, and flow along with a guide pipe 109 and a metering capillary tube 108 into the thermal compensation device 10 to enter an upper branch pipe 106 toward a plurality of thermal compensation capillary tubes 107 for dispersing and distributing the liquid refrigerant and the oil released from the dispersing and distributing the metering capillary tube 108. Then, the dispersed and distributed liquid refrigerant and oil gather at the lower branch pipe 106 and guided into a liquid receiver 104 via a guide pipe 105. Further, a plurality of distributing capillary tubes 103 parallel inject the liquid refrigerant into the U shaped pipes at the bends of the coil pipes 161 to conduct evaporation (heatabsorption) and cool air can be blown indoor with conventional fan and heat dissipating fins (not shown) to reach expected effect of cool room. The low temperature gaseous refrigerant and the oil are gathered at a manifold 102 disposed at the lower end of another main pipe 101 and connected to the lower end of the coil pipe 161 and then exit from another manifold 102 at the upper end of the main pipe 101 after passing through the main pipe 101. Next, the low temperature gaseous refrigerant and the oil enter the guide pipe section 62 of the delivering pipe 6 to allow the gaseous refrigerant and the oil rising temperature thereof and returning to the compressor after being performed with thermal compensation action. In this way, a refrigerant cycle is completed.

On the contrary, if a warm room effect is processed, the refrigerant moves along a path inversed to the preceding path of cool room, that is, the indoor heat exchanger 16 acts as a condenser (heatdischarge) and the outdoor heat exchanger 12 acts as an evaporator (heatabsorption) such that it can be obtained expected warm room effect.

As the foregoing, advantages of the air conditioning and refrigeration system with thermal compensation devices according to the present invention are summarized in the following:

(10) The thermal compensation capillary tubs 107 act as a kind of condensation intensifying device to disperse both the liquid refrigerant and the oil discharged from the metering capillary tube 108 and the dispersed liquid refrigerant and oil with gaseous refrigerant along with cold oil in the indoor heat exchanger 16 occur temperature difference complement in the main pipe 101. The cold oil is capable of absorbing heat of the coming liquid under the condition of heat absence and the liquid refrigerant and the oil from the metering capillary tub 108 dropped to the least temperature thereof.

(2) The liquid receiver 104 allows the liquid refrigerant and the oil providing best purity and mixing and the mixing proportion can be diluted to an optimum and best uniform state.

(3) The distributing capillary tube 103 injects the liquid refrigerant in parallel into the coil pipe 161 of the indoor heat exchanger 16 so that the liquid refrigerant disperses in the coil pipe 161 with self-micro-adjusting capability to obtain saturated iso-enthalpy expansion.

(4) The oil from the indoor heat exchanger 16 is primarily risen temperature thereof and softened after leaving the thermal compensation device 10 and the guide pipe section 62 separates the refrigerant from the oil in the same stream. The guide pipe section 61 adhered to the guide pipe section 62 performs thermal compensation function further to increase temperature of the refrigerant and the oil so that it is incapable of resulting in compressor frosting.

(5) Highest oil and gas temperature and softness with least oil-gas ration can be obtained such that the compressor can run with an input/output temperature difference exceeding 100° C. and the magnetic field can reach greatest power factor. Moreover, secondary voltage and electric magnetism created by the starting coil due to compensation action leading to high speed running such that the current can provide lower ampere and the cool room or warm room effect can be enhanced.

It is appreciated that the air conditioning and refrigeration system according to the present invention is a revision of the conventional cool air system to be capable of providing a warm air supplying system without increasing system cost largely. Even if the air conditioner is a window type in association with a rotary compressor, the purpose of slow running with fast temperature reduction can be reached by means of doubling refrigerant filling and flow process regulation. Meanwhile, hi/low pressure ratio 4:1 (cool room) or 81 even higher (warm room) is the most novel design of the air conditioner and it is capable of secure the indoor comfort. Besides, in case of the present invention being applied to the refrigeration system, the four-way valve allows flowing direction of the refrigerant being discharged to enhance the efficiency thereof without using tungsten filament for defrosting.

While the invention has been described with reference to the a preferred embodiment thereof, it is to be understood that modifications or variations may be easily made without departing from the spirit of this invention, which is defined by the appended claims.

What is claimed is:

1. An air conditioning and refrigeration system, comprising:

a compressor, connecting a four-way valve with a pipeline, the four-way valve being controlled to selectively direct high temperature gaseous refrigerant with oil moving along a delivering pipe toward an outdoor or an indoor heat exchanger;

two thermal compensation devices, being connected to both ends of the delivering pipe respectively and further connected to the outdoor heat exchanger and the indoor heat exchanger respectively, the two heat exchangers being connected to each other with another pipeline;

wherein, each of the thermal compensation devices having a branch pipe with a plurality of distributing capillary tubes at the terminate end thereof being attached to a coil pipe of the heat exchangers respectively for liquid refrigerant with oil being parallel injected into are guided out the heat exchangers and passing through a plurality of thermal compensation capillary tubes so as to occur thermal compensation with another liquid or gaseous refrigerant with oil guided or discharged by a manifold next to the heat exchangers before entering related circulating path;

whereby, cold oil from a evaporator absorbs heat of the liquid refrigerant by means of the the liquid refrigerant passing through the thermal compensation capillary tubes in the thermal compensation devices such that the oil increases temperature and is softened and the liquid refrigerant with oil drops to the least temperature.

2. The air conditioning and refrigeration system as defined in claim 1, wherein a filter is disposed between the compressor and the four-way valve.

3. The air conditioning and refrigeration system as defined in claim 1, wherein the delivering pipe provides two guide pipe sections to connect with two openings of the four-way valve such that one of the guide pipe sections acts as an initial end (discharge) and the other guide pipe section acts as a return end (suction).

4. The air conditioning and refrigeration system as defined in claim 1, wherein the two guide pipe sections are composed of a plurality of capillary tubes respectively to allow the refrigerant dividing from the oil and moving along with same direction.

5. The air conditioning and refrigeration system as defined in claim 1, wherein the two guide pipe sections have a part adhesively contacting to each other for creating thermal complement.

6. The air conditioning and refrigeration system as defined in claim 1, wherein each of the thermal compensation devices at least has a manifold connected to one of the guide pipe section for the high temperature gaseous refrigerant with oil passing through the main pipe of the respective thermal compensation device and move downward to the entrance of a coil pipe at the outdoor heat exchanger via at least another manifold below the main pipe such that most liquid refrigerant and the oil entering a distributor filter after being heat released via an outlet of the coil pipe and a check valve; the coil pipe is selectively connected to a plurality of divided capillary tubes for part of the liquid refrigerant with oil staying at a liquid receiver temporarily; the liquid refrigerant is guided to a branch pipe at the lower end of the main pipe via a leading pipe at the bottom end of the liquid receiver and passes through a plurality of thermal compensation capillary tubes to heat gain from the high temperature gaseous refrigerant with oil moving in the main pipe; and the temperature risen liquid refrigerant with oil is guided to another branch pipe at tope of the main pipe so as to flow into the distributor filter via a measuring capillary tube and another leading pipe.

7. The air conditioning and refrigeration system as defined in claim 1, wherein a condensation device is between the two heat exchangers and provides two condensation intensifying devices and two liquid distributor for being passed with the liquid refrigerant, the oil and bubbles from the distributor filter and a further condensation intensifying device is disposed between and connected to the liquid distributors for destruct the bubbles.

8. The air conditioning and refrigeration system as defined in claim 7 wherein the two liquid distributors are located below the outdoor heat exchangers and the indoor heat exchanger respectively.

9. The air conditioning and refrigeration system as defined in claim 1, wherein the liquid refrigerant and the oil after condensing action further pass through a liquid filter of the other thermal compensation device and are stopped by a check valve so as to flow along a further leading pipe and a metering capillary tube in the other thermal compensation device before entering an upper branch pipe and being directed to a plurality of thermal compensation capillary tubes and then are gathered at a lower branch pipe to be guided into a liquid receiver via a further leading pipe; further, a plurality of distributing capillary tubes parallel inject the liquid refrigerant into the coil pipe to perform evaporation action with self micro regulation capability due to increasing pressure by means of being atomized to vaporized so as to reach high saturation state of iso-enthalpy evoporation; low temperature gaseous refrigerant and the oil are gathered at a manifold disposed at he lower end of another main pipe and connected to the lower end of the coil pipe and then exit from another manifold at the upper end of the main pipe after passing through the main pipe such that the low temperature gaseous refrigerant and the oil enter the other guide pipe section of the delivering pipe to allow the gaseous refrigerant and the oil rising temperature thereof and suctioned to the compressor after being performed with thermal compensation action.

10. A thermal compensation device utilized in an air conditioning and refrigeration system, which is disposed at a front part of a vaporization state heat exchanger, comprising:

a branch pipe, providing a plurality of dividing flow capillary tubes at a terminal end thereof being joined to a coil pipe of the heat exchanger respectively;

a plurality of thermal compensation tubes, being disposed therein for being passed through with liquid refrigerant with oil while the liquid refrigerant with oil is parallel injected therein; and a manifold, surrounding the thermal compensation tubes, being passed through with lo pressure gaseous refrigerant with oil such that the liquid refrigerant with oil occurs thermal complement action with the gaseous refrigerant with oil before the lo side refrigerant with oil returning to a compressor along a guide pipe;

whereby, cold oil with heat absence from a evaporator absorbs heat of the liquid refrigerant passing through the thermal compensation capillary tubes in the thermal compensation devices to increase oil temperature and soften the oil and the hi pressure liquid refrigerant with oil is capable of lowering temperature thereof drop to the least temperature.

11. The thermal compensation device utilized in an air conditioning and refrigeration system as defined in claim 10, wherein the guide pipe returning to the compressor and another guide pipe initiating from the compressor provide a respective part thereof adhesively contacting to each other.

12. The thermal compensation device utilized in an air conditioning and refrigeration system as defined in claim 11, wherein the two guide pipes are composed of a plurality of capillary tubes respectively to allow the refrigerant dividing from the oil and moving along with each other.

13. The thermal compensation device utilized in an air conditioning and refrigeration system as defined in claim 10, wherein the liquid refrigerant with oil flows along a leading pipe and a metering capillary tube after being condensed and before entering an upper branch pipe and is directed to a plurality of thermal compensation capillary tubes; then are gathered at a lower branch pipe to be guided into a liquid receiver via a further leading pipe; further, a plurality of distributing capillary tubes parallel inject the liquid refrigerant into the coil pipe to perform evaporation action with self micro regulation capability due to increasing pressure by means of being atomized to vaporized so as to reach high saturation state of iso-enthalpy evaporation; low temperature gaseous refrigerant and the oil are gathered at a manifold disposed at the lower end of another main pipe and connected to the lower end of the coil pipe and then exit from another manifold at the upper end of the main pipe after passing through the main pipe such that the low temperature gaseous refrigerant rise temperature thereof and returning to the compressor after being performed with thermal compensation action.

* * * * *